US005927717A

United States Patent [19]

Berkovi et al.

[11] Patent Number: 5,927,717

[45] **Date of Patent: *Jul. 27, 1999**

[54] NUMERIC BOARD GAME

[76] Inventors: Jack Berkovi; Edger Fineberg, both of 118 Woodland Drive, Watford, Hertfordshire WD1 3DB, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/806,936

[22] Filed: Feb. 26, 1997

[51] Int. Cl.[6] ..... A63F 3/00

[52] U.S. Cl. ..... 273/271

[58] Field of Search ..... 273/264, 271, 273/272

[56] References Cited

U.S. PATENT DOCUMENTS

| | | | |
|---|---|---|---|
| 1,558,690 | 10/1925 | McCollom | 273/271 |
| 1,564,746 | 12/1925 | Barnard | 273/271 |
| 1,607,660 | 11/1926 | Zabriskie | 273/271 X |
| 1,871,247 | 8/1932 | Trost | 273/271 |
| 3,342,493 | 9/1967 | Lang | 273/271 |
| 3,545,101 | 12/1970 | Fike | 273/271 X |
| 3,659,851 | 5/1972 | Lang et al. | 273/271 |
| 3,975,021 | 8/1976 | Brown . | |
| 4,092,029 | 5/1978 | Jones | 273/271 |
| 4,114,290 | 9/1978 | Cooper . | |
| 4,720,108 | 1/1988 | Gramera | 273/271 X |
| 5,478,087 | 12/1995 | Dumisani | 273/272 |
| 5,560,612 | 10/1996 | Ippoliti et al. | 273/272 |

FOREIGN PATENT DOCUMENTS

| | | | |
|---|---|---|---|
| 2113103 | 8/1983 | United Kingdom | 273/271 |
| WO9214525 | 9/1992 | WIPO . | |

*Primary Examiner*—William E. Stoll
*Attorney, Agent, or Firm*—Christie, Parker & Hale, LLP

[57] ABSTRACT

A numeric board game includes a board divided into differently numbered hexagons. Four dice are provided which when thrown will yield four numbers. The player must compute all four random numbers in a mathematical operation to arrive at one of the numbers in the hexagons which hexagon is then covered with a counter. Each hexagon is coded with a colour designating a different monetary value so that the player covering a hexagon with a counter will draw currency corresponding to the monetary value indicated, from a central bank. The player with the greatest wealth wins the game.

9 Claims, 5 Drawing Sheets

FIG. 1

10

| | | | | | |
|---|---|---|---|---|---|
| 1 G | 2 S | 3 S | 4 | 5 G | 6 |
| 7 G | 8 | 9 | 10 | 11 G | 12 |
| 13 S | 14 | 15 | 16 | 17 S | 18 |
| 19 G | 20 | 21 | 22 | 23 S | 24 |
| 25 | 26 | 27 | 28 | 29 G | 30 |
| 31 S | 32 | 33 | 34 | 35 | 36 |
| 37 G | 38 | 39 | 40 | 41 G | 42 |
| 43 S | 44 | 45 | 46 | 47 S | 48 |
| 49 | 50 | 51 | 52 | 53 G | 54 |
| 55 | 56 | 57 | 58 | 59 S | 60 |
| 61 G | 62 | 63 | 64 | 65 | 66 |
| 67 S | 68 | 69 | 70 | 71 S | 72 |
| 73 S | 74 | 75 | 76 | 77 | 78 |
| 79 G | 80 | 81 | 82 | 83 | 84 |
| 85 | 86 | 87 | 88 | 89 S | 90 |
| 91 | 92 | 93 | 94 | 95 | 96 |
| | 97 G | 98 | 99 | 100 | |

10

| | | | | | | |
|---|---|---|---|---|---|---|
| 1 G | 2 S | 3 S | 4 | 5 G | 6 | |
| 12 | 11 G | 10 | 9 | 8 | 7 G | B £5 |
| 13 S | 14 | 15 | 16 | 17 S | 18 | |
| 24 | 23 S | 22 | 21 | 20 | 19 G | |
| 25 | 26 | 27 | 28 | 29 G | 30 | 0 £10 |
| 36 | 35 | 34 | 33 | 32 | 31 S | |
| 37 G | 38 | 39 | 40 | 41 G | 42 | |
| 48 | 47 S | 46 | 45 | 44 | 43 S | G £20 |
| 49 | 50 | 51 | 52 | 53 G | 54 | |
| 60 | 59 S | 58 | 57 | 56 | 55 | |
| 61 G | 62 | 63 | 64 | 65 | 66 | Y £50 |
| 72 | 71 S | 70 | 69 | 68 | 67 S | |
| 73 S | 74 | 75 | 76 | 77 | 78 | |
| 84 | 83 G | 82 | 81 | 80 | 79 G | R £100 |
| 85 | 86 | 87 | 88 | 89 S | 90 | |
| 96 | 95 | 94 | 93 | 92 | 91 | |
| | 97 G | 98 | 99 | 100 | | |

NUMERIC BOARD GAME

BACKGROUND OF THE INVENTION

1. Field of the Invention

The present invention relates to a numeric board game.

2. Description of the Prior Art

A large variety of board games exist involving vocabulary skills which allow players to enjoy exercising their vocabulary. Such games also act as a teaching aid to improve the vocabulary of individuals in education.

Very few board games exist involving numerical skills. Such that there are, are confined to a limited number of mathematical operations such as addition or subtraction.

It is an object of the present invention to provide an improved numeric board game.

SUMMARY OF THE INVENTION

According to the present invention is a numeric game comprising a board divided into a plurality of separate zones, a plurality of random number devices and a plurality of playing pieces, one of said plurality of playing pieces and said plurality of zones being numbered so that each member of said plurality carries a different number, and a set of rules, the rules requiring the following from each player:

a) The operation of said random number devices to form discrete numbers;

b) the selection of a zone or playing piece with the selected number;

c) the application of one or more similar or different mathematical operations to create from the discrete numbers the selected number;

d) the positioning of a playing piece on the zone with the selected number or the positioning of the playing piece with the selected number on a zone;

e) operating a scoring scheme for each piece positioned in a zone; and f) terminating the game when a player reaches or exceeds a predetermined target score.

Numeric board games embodying the present invention, will now be described, by way of example, with reference to the accompanying diagrammatic drawings.

DESCRIPTION OF THE DRAWINGS

FIG. 1 is a plan view of the board and pieces used in a first example of the game;

DESCRIPTION OF THE PREFERRED EMBODIMENT

EXAMPLE I

The game consists of a board carrying an array of rectangles arranged in rows and columns. The rectangles are numbered in sequence from one to a hundred. Also, provided (but not shown) are four normal dice, one hundred circular counters, a stack of paper money and a set of rules.

The rules specify that each player throws all four dice in turn. The player throwing the dice must then take all four numbers shown by the dice and computate mathematically a number in the range from one to a hundred (without any remainders) and if the number computed is not already covered, take a counter and cover that number on the board. The player then takes a unit of currency. If the number computed is already covered then the player must compute another number. If the player fails to compute any free number, the play moves onto the next player and no unit of currency is taken. The players take successive turns until all the numbers on the board are covered and the winner is the player holding the greatest amount of currency.

This is one of the simplest forms of the game in which the mathematical computations are limited to addition, subtracting, multiplication and division. Other mathematical operations can be brought in if desired.

EXAMPLE II

Figure 2:
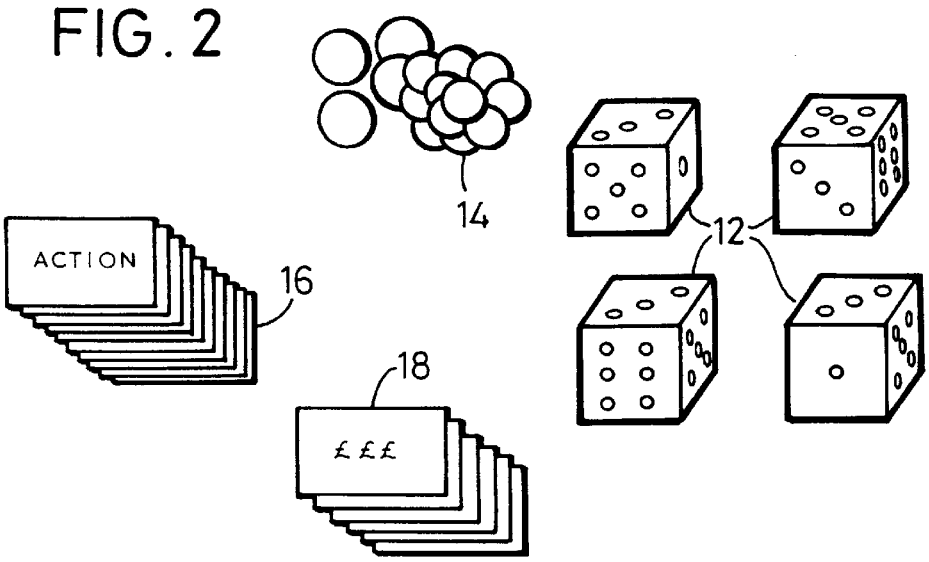
FIG. 2 is a perspective view of a modified version of the board of FIG. 1.

The game shown in FIG. 2 consists of a board 10, a set of four dice 12, four sets of different coloured counters 14 (twenty five counters per set), a stack of twenty-five action cards 16 and several stacks of paper currency 18.

The board 10 consists of one hundred rectangles arranged in rows and columns and numbered consecutively one to a hundred. The rectangles from one to twenty four are coloured blue and are located in area B. In area B, the rectangles are valued at £5 each. The rectangles from twenty five to forty two are coloured orange and are located in area O. In area O, the rectangles are valued at £10 each. The rectangles from forty three to sixty are located in area G and coloured green. Each green square is valued at £20. The rectangles from sixty one to seventy eight are coloured yellow. The yellow coloured rectangles are located in area Y and are valued at £50 each. The red rectangles are numbered from seventy nine to a hundred, located in area R and valued at £100 each.

The prime number rectangles are additionally ringed in either gold or silver as represented by the letters G and S in the relevant rectangles.

The paper currency 18 is provided in a similar number of denominations as genuine currency.

The twenty five action cards each bear a different instruction. The different instructions are as follows:

If your number divides by six, give £100 to the Bank.

Win a local raffle—collect £50 from the Bank.

Special Action card—You can end the game now, or take £200 from the Bank.

Bonus time—collect £100 from each player, or playing pair.

Bonus time—collect £200 from the Bank.

Pay Bank £100 for special services.

Party costs you £200—pay into the Bank.

If you used a division sign to form your number, collect £250 from the Bank, if not collect £100.

Special Action card—You can end the game now, or take £300 from the Bank.

Lose a bet—give every player £20.

Accounting mistake—give £100 to the Bank.

Pay your debts—give all players £20.

Double your rewards! Bank pays you the same amount again.

Top of the class! All players give you £20.

Win number award—Bank pays you £200.

If your number is prime and silver, collect £50 from the Bank; if it is prime and gold, collect £150.

If you threw four of the same number collect £400 from the Bank, if three of the same number collection £300; if two the same collect £200.

Treble your reward and collect if from the Bank.

Double your reward and collect if from the Bank.

If your number is even, collect £50 from the Bank; if it is odd pay £10 to all players.

Players in your debt—all players give you £50.

If your number is even, give £20 to all players; if it is odd receive £20 from each player.

Lottery win—receive £250 from the Bank.

If your number is prime silver collect £150 from the Bank; if it is prime gold collect £250.

If you used a subtraction sign to form your number receive £200 from the Bank.

This version is a fast-moving number game for 2–8 players. It is designed to help players use, develop and improve their basic arithmetic skills in an enjoyable way that rewards success.

OBJECT OF THE GAME

The idea of the game is to compute numbers from dice thrown, place counters on the board to cover the corresponding numbers computed and gain monetary rewards. The winner is the player who has built up the highest amount of money after an agreed end point has been reached.

PREPARATIONS FOR PLAY

The board is placed on a large table.

A Banker is chosen to take care of the money. Each player is given £500 at the start, divided as follows: Two—£100; four—£50; three—£20; four—£10. All remaining money goes to the Bank.

The Action cards (16) are shuffled and placed face down on the board on the marked area.

Each player choses one set of coloured counters (red, yellow, blue or green) to use during the game. Players can choose to play in pairs if they wish. Thus, up to four pairs can play.

Players then decide how to end the game, for example the first player to achieve funds of £2,000. Starting with the Banker, players each throw a die; the highest scoring player will play first. Play then proceeds in a clockwise fashion.

THE PLAY OF A TURN

A player's turn consists of several steps—throwing the dice; computing a number; covering the corresponding number on the board with a counter and taking a reward.

Step 1—Throwing the dice

The first player throws the dice and the dice are not thrown again until all the players have taken a turn in computing a different number from the dice as thrown. The player who throws the dice has the first play on the board.

Step 2—Creating a number

The numbers shown on the top face of all the dice are then computed or manipulated by each player in turn using any of the standard addition, subtraction, multiplication or dividing processes (individually or in combination) to create a number between one and a hundred. Numbers shown on the dice can be grouped (bracketed) before being manipulated.

Here are some examples of such manipulations:

With four dice, producing numbers 6, 4, 3 and 1 and four players: the four players may produce the numbers 14, 72, 96 and 6, which are computed as follows:

$6+4+3+1=14$; $6\times4\times3\times1=72$; $(6\times4)\times(3+1)=96$; $(6/3)\times(4-1)=6$ Thus these four numbers could be created from a single throw of the dice.

When the first player has created a number they announce it, state how it was formed and continue their turn. Once a number is covered the remaining players must create different numbers from the same throw. Players may use pencil or pen and paper to work out their numbers.

Step 3—Covering the number on the board and taking a reward

The skill test as the game develops is to build up the highest monetary reward.

On, the first turn, the first player covers the number formed with a coloured counter. The Bank awards a reward for any number covered. Numbers are grouped in coloured zones, each zone has a money value which increases progressively as number size increases up the board.

Prime numbers are marked with either a silver or gold border.

If the covered number is prime and silver the reward is doubled; if it is a prime and gold the reward is trebled.

When a prime number is covered the player takes an Action card from the top of the pack and follows the instructions stated on the card. The card is then returned to the bottom of the pack.

The second player now covers their number and takes their reward.

Play continues until all players have covered different numbers from the same throw of dice.

The player to the left of the previous player now throws the dice and play continues in a clockwise fashion.

HOW TO END THE GAME

There are various ways of ending the game but preferably the winner is the player with the most money at the agreed end point.

Players should decide the end point at the start of the game, before the first turn.

Examples of ending the game time limit (example one hour)

one straight line of numbers covered across or down the board one straight line of numbers covered by counters of one colour one coloured zone completely covered two coloured zones covered pre-agreed funds total reached (example: £2,000)

all prime numbers covered (all silver and gold border areas)

all 100 numbers covered (longest duration)

PENALTIES

The Action cards contain rewards or penalties. If the action taken on a penalty causes a player to lose all their money, they can either forfeit their place in the game or join another player (or players) to help them with number creation.

VARIATIONS OF THE GAME

| Ages | |
|---|---|
| 6–8 | In this age range it is suggested that three dice are used instead of four. While this limits the number creation, it provides an easier entry to the game. For ages 9 to 11 it is suggested that three dice are used to begin with, then moving to four dice once the idea of the game has been fully grasped. The use of pencil/pen and paper to calculate numbers is recommended. The Action cards can be used but this is optional. |
| 11+ to Adult | Four dice should be used and the Action cards. To ensure that the game does not proceed too slowly, a timer, for example a sand timer or clockwork timer, can be used to define the maximum time allowed for each move. |

EXAMPLE III

This game has the same components as the game of Example II but the board displays an array of interlocking hexagons numbered from one to a hundred and the rules are slightly different.

Figure 3:
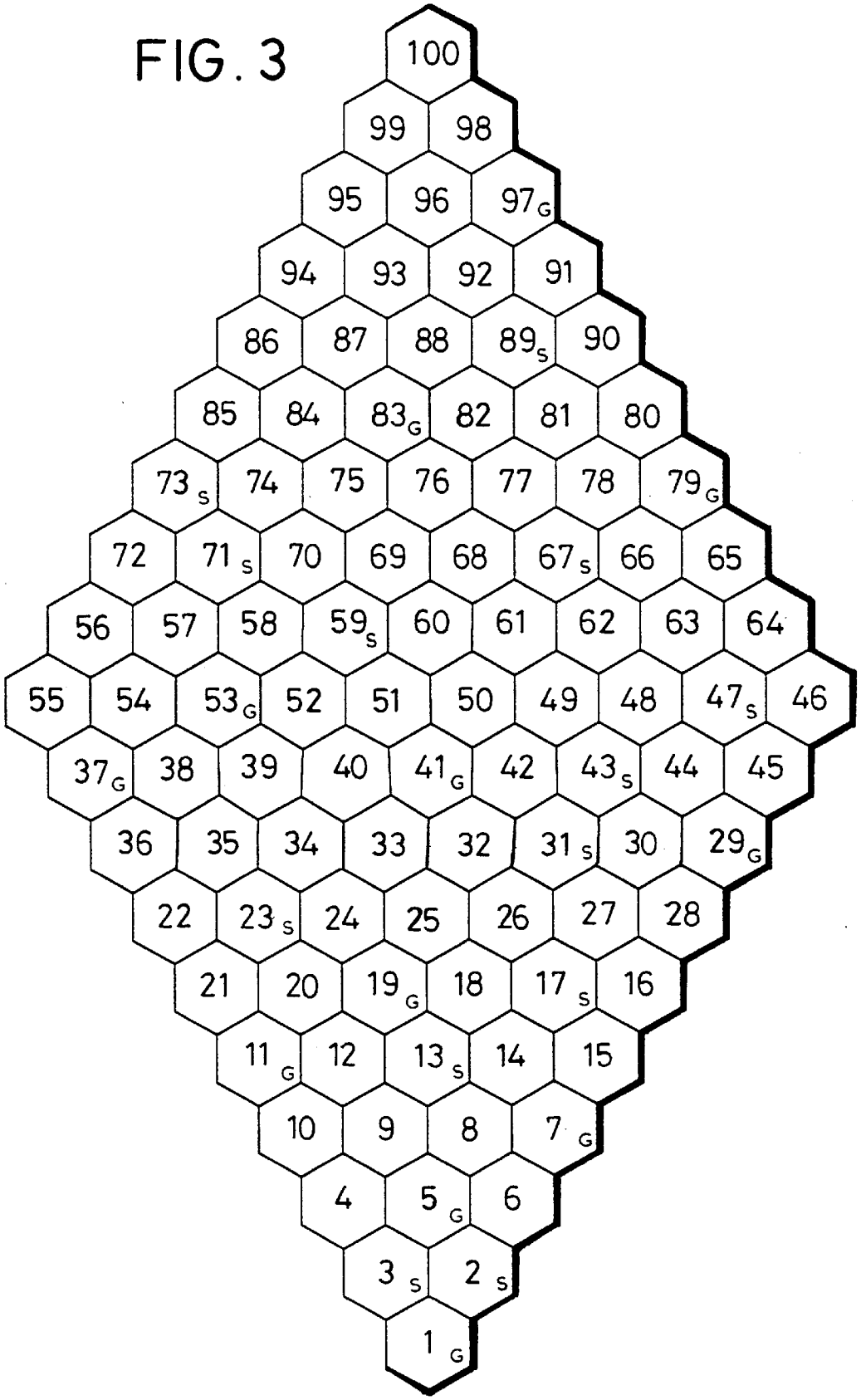
FIG. 3 is a plan view of a board for another version of the game.

The board, as shown in FIG. 3, includes a diamond shaped area fitted with hexagons numbered in ascending order with the lowest number one in the lowest hexagon and the highest number one hundred in the highest hexagon. The hexagons may be grouped, with each group consisting of a plurality of successive rows of hexagons. Each group is allocated a different colour. Thus, hexagons one to fifteen are violet, sixteen to twenty nine are indigo, thirty to forty three are blue, forty four to fifty seven are green, fifty eight to seventy one are yellow, seventy two to eighty five are orange and eighty six to one hundred are red.

The hexagons carrying prime numbers are additionally bordered in either silver or gold and this is represented by the letter S for silver border and G for a gold border.

The first three steps of this game are similar to the first three steps of the game of Example II.

The third step, however, is as follows:

Step 3—Covering the number on the board and taking a reward

Rewards can come from:

forming a number (ordinary or prime) which is not already covered making connections in different directions between covered numbers.

The skill test as the game develops is to create connected groups of numbers to build up the highest monetary reward.

On the first turn, the first player covers the number formed with a coloured counter. The Bank awards a £10 reward for any number covered; however if the number is prime and silver the reward is doubled to £20; if it is prime and gold the reward is trebled to £30.

As each number on the board is covered a monetary reward of £10 is awarded to the player covering the number. The money is taken from the Bank. If the number covered is adjacent to another covered number or numbers, the reward is made up of all 'connected' numbers at £10 per number. The hexagonal playing areas enable the numbers to be adjacent in at least two and up to six directions depending upon their location.

The second player now covers their number. If the number is next to a covered number the reward is made up of all 'connected' numbers in a straight line at £10 per number.

For example, if the first player created the number 68 and the second player created number 76, the second player receives £20 because 68 and 76 are adjacent to each other.

If the third player now created number 61, it can be seen that this has formed a straight line of three numbers and, since 61 is also prime gold, the reward will be £50, since 61 yields a reward of £30.

Step 4—Dealing with intersections and taking Action cards

Covering a number automatically entitles the player to a reward; however, if the number covered creates links between lines of covered numbers, there will be additional rewards or possibly penalties involved.

Connections can occur in up to three directions. If the placement of a counter creates a connection of covered numbers in several directions simultaneously, all numbers covered are counted for the reward of £10 per number. The reward is taken from the Bank. When such a connection is made, the player calls out "Action" and takes an Action card from the top of the pack. The card features information relating to an additional reward (or a penalty) applied to that turn and the player has to follow the instructions stated on the card before the next player's turn. When the card has been used it is returned face down to the bottom of the Action pack.

How to end the game

There are various ways of ending a game; the winner is the player with the most money at the agreed end point. Players should decide the end point at the start of the game, before the first turn.

time limit (example one hour)

one straight line of at least six hexagons covered (example: numbers 16–21)

one straight line of six or more hexagons covered by the same colour counters one spectral colour area completely covered (example: red, numbers 86–100)

two spectral colour areas covered (example: violet and blue)

pre-agreed funds total reach (example: £5,000)

all prime numbers covered (all silver and gold bordered hexagons)

all one hundred numbers covered (longest duration)

Penalties

The Action cards contain rewards or penalties. If the action taken on a penalty causes a player to lose all of their money, they can either forfeit their place in the game or join another player or players to help them with number creation.

Variations of the game

The game can be played at several levels, in terms of ages of players, strategy and tactics.

| Ages | |
|---|---|
| 6–8 | In this age range it is suggested that three dice are used instead of four. While this limits the number creation it provides an easier entry to the game. For ages 9 to 11 it is suggested that three dice are used to begin with, then moving to four dice once the idea of the game has been fully grasped. The use of pencil/pen and paper to calculate numbers is recommended. The Action cards can be used but it is optional. |
| 11+ to Adult | Four dice should be used and Action cards. |

EXAMPLE IV

This version of the game is different from the herein previously described versions of games in that the counters are numbered from one to a hundred and the board is un-numbered.

The game consists of a board, a set of one hundred counters numbered from one to a hundred, four dice, several stacks of paper money and a pack of Action cards. The stacks of paper money and the Action cards are the same as used in the previously described versions of the game. The counters are stored in an opaque bag (not shown) so that they can be selected by the players at random and without having sight of them before selection.

Figure 4:
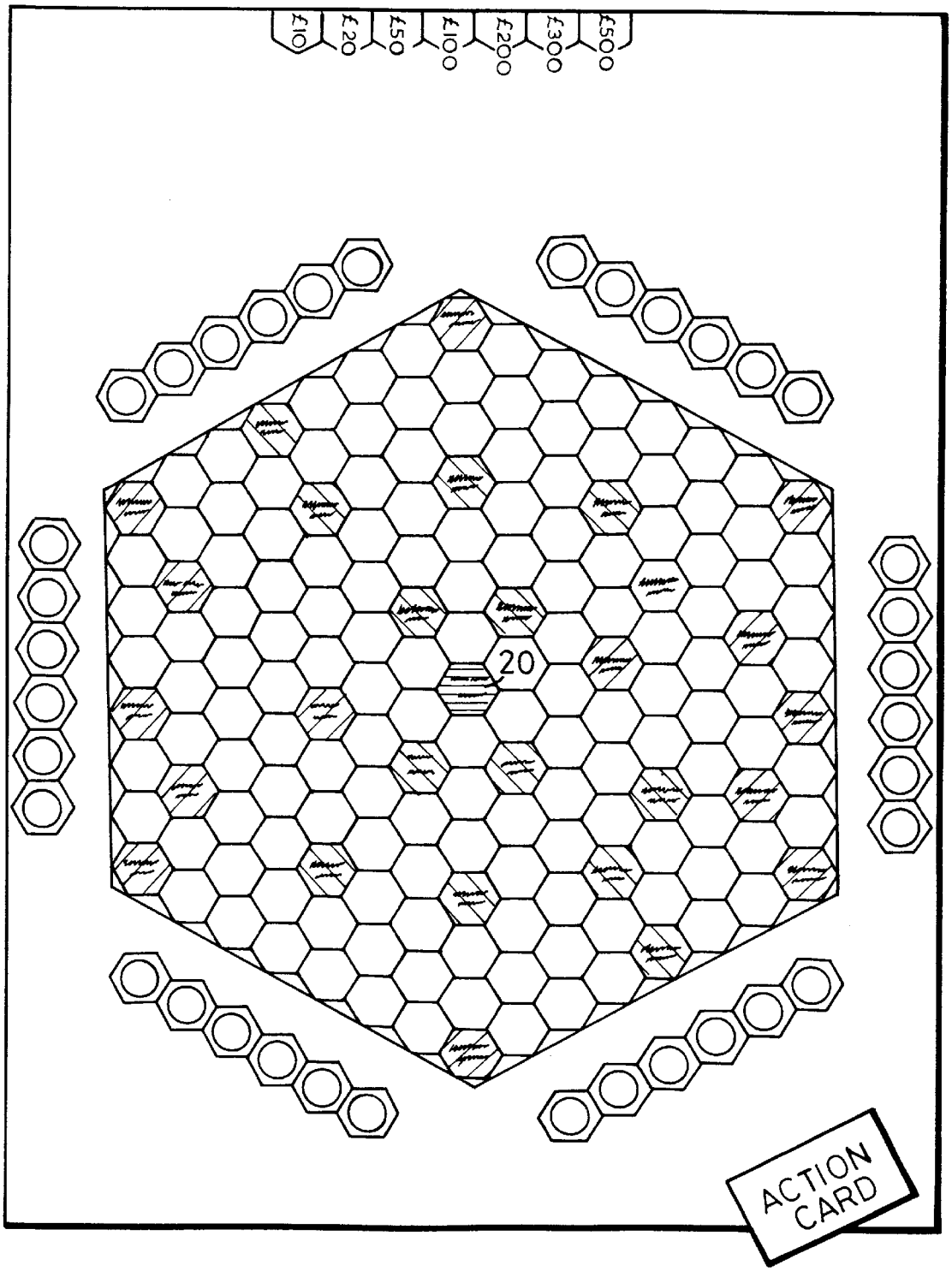
FIG. 4 is a plan of a board of yet a further version of the game.

The board as shown in FIG. 4 consists of an array of hexagons arranged in concentric groups about a starting hexagon 20. The groups are differently coloured. Randomly selected hexagons are labelled "Double Bonus" or "Triple Bonus".

The hexagons are arranged in a contiguous interlocking relationship with each other inside a hexagonal area. Adjacent each of the six outer boundaries of the hexagonal area is a line of six hexagons arranged to receive six counters. Each line of hexagons is allocated to a different player. At one end of the board are marked spaces for receiving a stack of currency of different denominations, the "Bank". At the other end of the board is a marked area for receiving the pack of Action cards.

OBJECT OF THE GAME

The idea of the game is to form numbers from thrown dice, place numbered counters on the playing board, make number connections and gain money bonuses. The winner is the player who has built up the highest amount of money after an agreed end point has been reached. The game can develop into various strategic and tactical levels depending upon the ability of the players.

PREPARATIONS FOR PLAY

The board is placed on a large table

A Banker is chosen to take care of the money. Each player is given £500 at the start, divided as follows: Two—£100; four—£50; three—£20; four—£10. All remaining money goes to the Bank.

The numbered counters (numbered one to a hundred) are placed in the bag. Each player takes six counters to use at the start of the game. Prime numbers are on counters coloured silver or gold and have extra scoring value over non-prime numbers. Players place their six counters face up in the spaces provided at the edge of the board, so all players can see each other's numbers.

The Action cards are shuffled and placed face down on the board on the marked area.

Players then decide how to end the game, for example the first player to achieve funds of £5,000. Starting with the Banker, each player throw a die; the highest scoring player will play first. Play then proceeds in a clockwise fashion.

HOW TO START THE GAME

The play of a turn:

A player's turn consists of several steps—throwing the dice; creating a number to match a numbered counter; placing a numbered counter on the board and taking a reward, and dealing with intersections.

Step 1—Throwing the dice

The first player throws the dice. The numbers shown on the top surface of the dice are used by all players simultaneously. The player who throws the dice has the first play on the board.

Step 2—Creating a number to match a numbered counter

The numbers shown on the top face of all the dice are then computed or manipulated by all players using any of the standard addition, subtraction, multiplication or dividing processes (individually or in combination) to create numbers between one and a hundred, so that a player's number matches one or more of the six numbered counters that they picked out of the bag. Numbers shown on the dice can be grouped (bracketed) before being manipulated.

Here are some examples of such manipulations:

With four dice, throwing the numbers 6, 4, 3 and 1, it is possible to make at least the twelve numbers: 1, 2, 4, 6, 7, 8, 12, 14, 40, 72, 73 and 96, as follows; $(3\times1)-(6-4)=1$; $(6/3)\times(4-1)=6$; $6+4+3-1=12$; $(6+3)-(4+1)=4$; $6+4+3+1=14$; $(6+4)\times(3+1)=40$; $(4\times3)/6=2$; $6\times4\times3\times1=72$; $(6\times4\times3)+1=73$; $(6+4-3)/1=7$; $(6\times4)/(3\times1)=8$; $(6\times4)\times(3+1)=96$;

When the first player has created a number they announce it, state how it was formed and continue their turn. Once a numbered counter has been used the remaining players must try to create different numbers from the same throw of the dice. Players may use pencil or pen and paper to work out their numbers.

Step 3—Placing the numbered counter on the board

The first numbered counter is placed in the hexagon in the centre of the board. This play qualifies for a starting bonus (see Rewards). All following counters played must be placed in a space next to one of the counters already placed on the board. A player can only place a counter on the board if:

the number has been formed from the four dice thrown the number relates in some way to a number on an adjacent counter or counters; it can be:

| | |
|---|---|
| consecutive | (4, 5, 6 . . . ) above or below |
| prime | (1, 2, 3, 5, 7, 11 . . . ) |
| a multiple | (4, 8, 12, 16 . . . ) |

Here are some examples of related plays on the board:

21 placed next to 22 (consecutive)

4 placed next to 8 (multiples; both divided by 4);

5 placed next to 11 (both are prime numbers)

As the counters are played, it is possible for three or more numbers to be related in different directions.

Figure 5:
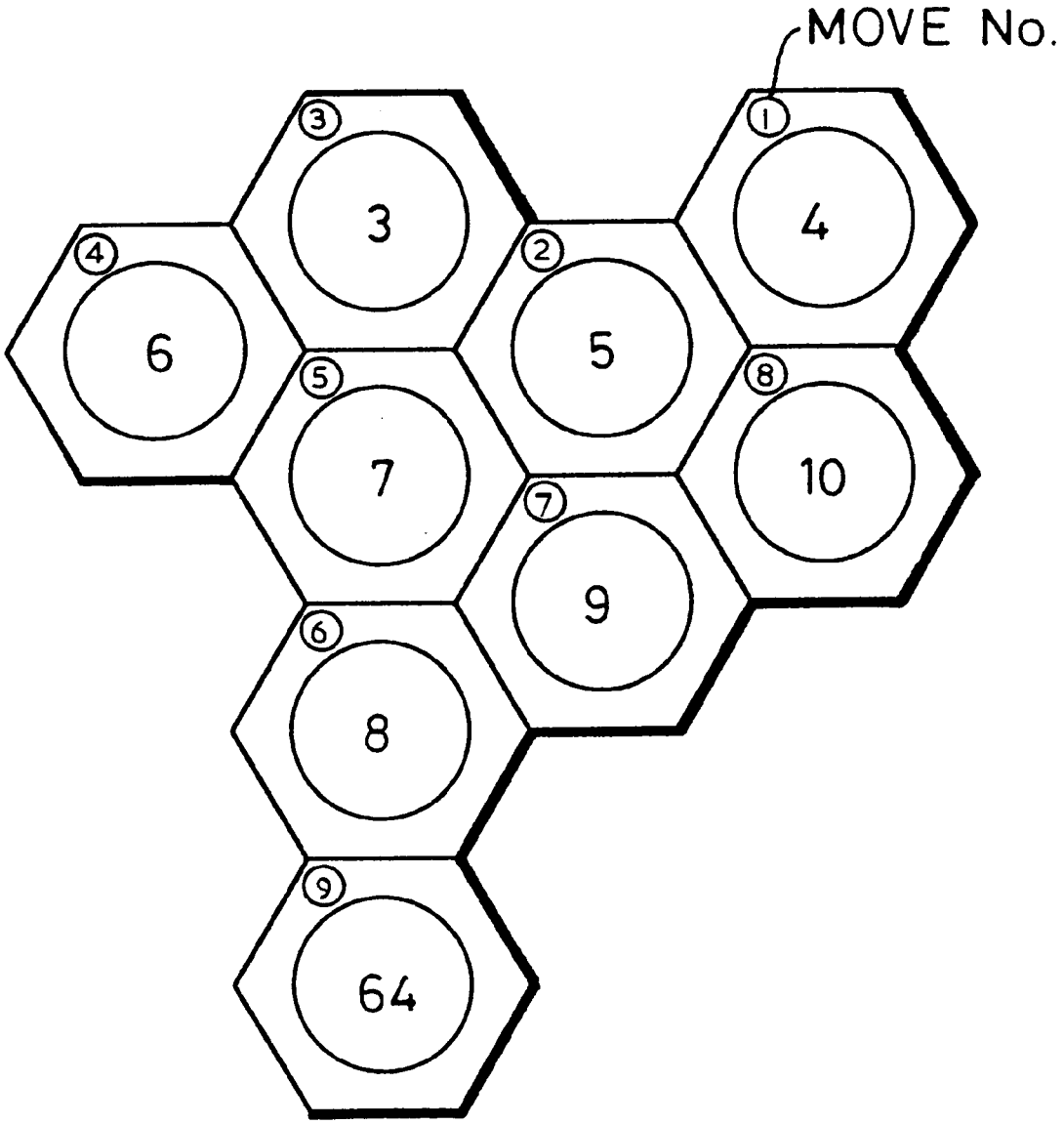
FIG. 5 is a fragmentary view, to an enlarged scale, of the board of FIG. 4 illustrating the play of the game.

FIG. 5 shows an example of nine moves from the start of a game; rewards will be explained later.

Move 1 4 played in the centre space

Move 2 5 played in the violet zone, next to 4 (consecutive)

Move 3 3 played in the indigo zone, next to 5 (both numbers are prime)

Move 4 6 played in the blue zone, next to 3 (both numbers multiples of 3)

Move 5 7 played in the indigo zone, touching numbers 3, 5 and 6 in two different directions. This is called 'connecting', because numbers 3 and 5 relate to 7 as follows:

- 3, 5 and 7 are all prime, so 7 can be placed next to 3 and 5
- 7 follows six in sequence Move 6 8 is played touching number 7 (8 follows 7 consecutively)

Move 7 9 is played next to 5, 7 and 8 (9 follows 8 consecutively; note this is not connecting because 9 does not relate to 5 or 7)

Move 8 10 is played next to 5 and 9. Again we have a 'connection', between these three numbers.

- 10 and 5 are both multiples of 5
- 10 follows 9

Move 9 64 is played next to 8, in the green zone; both numbers are multiples of 8.

Step 4—Taking a reward

Rewards, called 'bonuses' can come from:

placing the first counter in the centre, receiving a starting bonus of £10. This is doubled if the number placed is prime silver, and trebled if it is prime gold placing a numbered counter on any other unoccupied space on the board, next to another occupied space; counters placed in the violet zone gain £10, in indigo £20, in blue £50, in green £100, in yellow £200, in orange £300 and in red £500 placing a numbered counter on a specially marked hexagon, receiving a double or triple bonus making connections in different directions simultaneously between numbers, receiving a bonus for every counter which is contiguous and double/triple rewards as appropriate when a player uses three or more of their counters taken from the bag in the same 'turn' (from one throw of the dice); this qualifies for a special bonus of £1,000.

The skill test as the game develops is to create connected groups of numbers to build up the highest monetary reward.

Examples of rewards from a game

All placed counters qualify the player for an automatic bonus based on the coloured zone where the counter was placed, to which is added £10 for all other adjacent related counters.

Let us look at the bonuses awarded for the nine moves shown earlier.

| | |
|---|---|
| Move 1 | 4 played in the centre qualifies for a starting bonus of £10. |
| Move 2 | 5 (prime gold) played in the £10 violet zone next to 4, qualifies for a total bonus of £40. This comes from the prime bonus of £30 (because 5 is a gold prime) to which is added £10 for the number 4 already played. |
| Move 3 | 3 (prime silver) played in the £20 indigo zone next to 5, qualifies for a total bonus of £50. This comes from the prime bonus of £40 (double £20) to which is added a £10 zone bonus for 5 in the violet zone. |
| Move 4 | 6 played in the £50 blue zone next to 3 qualifies for a total bonus of £70; made up of £50 from placing 6, to which is added £20 for the link with the number 3. |
| Move 5 | 7 (prime gold) played in the £20 indigo zone, touching 3, 5 and 6, qualifies for a total bonus of £110; made up of £60 for 7 in the indigo zone (£20 is trebled because 7 is gold prime), plus zone bonuses; £10 for the link with 5, £20 for the link with 3 and another £20 for the link with 6. |
| Move 6 | 8 played in the £50 blue zone, touching 7, qualifies for a total bonus of £70; made up of £50 for 8 in the blue zone plus £20 for 7 in indigo. |
| Move 7 | 9 played in the £20 indigo zone, touching 5, 7 and 8, qualifies for a total bonus of £100; made up of £20 for 9 in indigo, plus zone bonuses of £10 for 5, £20 for 7 and £50 for 8. |
| Move 8 | 10 played in the £10 violet zone next to 4, 5 and 9, qualifies for a total bonus of £30; made up of £10 for 10 in violet, plus zone bonuses of £10 for 4, £10 for 5 and £20 for 9. |
| Move 9 | 64 played in the £100 green zone next to 8, qualifies for a total bonus of £150; made up of £100 for 64 in green plus £50 for 8 in blue. |

Step 5—Dealing with intersections and taking Action cards

As numbers are progressively covered during play, clusters of adjacent numbers form in two or three directions.

If the placement of a counter creates a link between a number in several directions simultaneously, all numbers are counted for the reward. This is known as 'connecting' and the player calls out 'connect' or some other chosen word and the reward is taken from the Bank. An Action card is taken from the top of the pack and the player follows the instructions stated on the card. The card is then returned face down to the bottom of the Action pack.

Examples of connecting from the previous nine moves are:

| | | |
|---|---|---|
| • | Move 5 | 7 played next to 3, 5 and 6 |
| • | Move 8 | 10 played next to 5 and 9 |
| • | Thus it is more rewarding to 'connect' in the higher nuinber zones than in the lower number zones. | |

Play continues clockwise until everyone has tried to place one number counter on the board. If a player cannot form a suitable number from the thrown dice when it is their turn, they miss that turn and play passes to the next player.

When all players have placed (or tried to place) one numbered counter, any player can now try to make any other numbers shown on unplayed counters from the same dice throw and gain bonuses. Players can move as quickly as they wish. Players try to use as many of their numbered counters as possible, or they can use other players' counters if they can form the numbers.

Once all players have finished trying to form new numbers from the original throw of the dice, the play passes to the next player who throws the dice again and has a turn.

How to end the game

There are various ways of ending a game; the winner is the player with the most money at the agreed end point.

Players should decide the end point at the start of the game, before the first turn.

Examples of ending the game time limit (example one hour)

pre-agreed funds total reached (example: £5,000)

all hundred numbered counters used (longest duration)

Penalties

Action cards

The Action cards contain rewards or penalties. If the action taken on a penalty causes a player to lose all of their money, they can either forfeit their place in the game or join another player (or players) to help them with number creation.

Unable to form a number to fill a remaining space on the board

As the board becomes progressively covered by counters, it is possible that all attempts to form a number which remain are exhausted. In this case, the player forfeits a turn and play passes to the next player.

Variations of the game

The game can be played at several levels, in terms of ages of players, strategy and tactics.

| Ages | |
|---|---|
| 6–7 | Three dice at the start; Action cards optional. In this age range it is suggested that three dice are used instead of four. While this limits the number creation, it provides an easier entry to the game. |
| 8–10 | Three dice, then four with Action cards. For ages 8 to 10 it is suggested that three dice are used to begin with, then moving to four dice once the idea of the game has been fully grasped. The Use of pencil/pen and paper to create numbers is recommended. |
| 11+ to Adult | Four dice should be used with Action cards. |

Strategies and tactics

The choice of how to end a game can lead to different playing strategies and tactics.

For example, if the placement of all prime numbers will end the game, a player might avoid playing the last remaining number if it would mean losing the game.

As numbers are placed on the board, a player may be preparing for a particular connection to gain high reward, other players may try to prevent this by creating different number connections.

Pairs or teams

The game can be played by up to six pairs of players, each pair using six counters.

Another option is to create competing teams of three, four or six players, with up to twelve people in all seated around the board.

Simulations of the game

The components, instead of being presented in real form, can be presented in simulated form such as in a computer display or in a TV show version of the game.

Given the wide variations of components and rules with which the game described can be played and which are all within the scope of this concept, one is cautioned not to restrict the invention to the embodiments specifically disclosed and illustrated, but rather encouraged to determine the scope of the invention only with reference to the following claims.

We claim:

1. A numeric game comprising a board, means defining a plurality of separate zones on the board, wherein the zones are hexagons arranged in an interlocking array, a plurality of random number generators, each random number generator adapted to randomly display one of a plurality of possible numbers, said plurality of random number generators capable of displaying a corresponding plurality of random numbers simultaneously, a plurality of playing pieces, wherein constituent members of said plurality of playing pieces or of said plurality of zones are numbered so that each member of said numbered plurality carries a different number, and a set of rules, the rules requiring the following from each player:

a) the operation of said random number generators to display discrete numbers simultaneously;

b) the application of one or more similar or different arithmetic operations to create from the discrete numbers a selected number;

c) the selection of a zone or playing piece with the selected number;

d) the positioning of a playing piece on the zone with the selected number or the positioning of the playing piece with the selected number on a zone;

e) operating a reward scheme for each piece positioned in a said zone; and f) terminating the game when a player reaches or exceeds a predetermined target reward in said scheme.

2. A game according to claim 1, wherein each playing piece comprises a counter carrying a different one of said plurality of numbers.

3. A game according to claim 2, wherein the plurality of zones are one hundred and are numbered from one to a hundred.

4. A game according to claim 3, the rules specifying that after a first said counter has been placed on the board, successive said counters must be placed in contiguous relationship with another said counter on the board.

5. A numeric game comprising a board;

means defining a plurality of separate zones on the board, wherein the zones are hexagons arranged in an interlocking array, and wherein the plurality of zones are one hundred and are numbered with a plurality of numbers from one to a hundred;

a plurality of random number devices comprising four standard dice;

a plurality of playing pieces, wherein each playing piece comprises a counter carrying a different one of said plurality of numbers; and a set of rules, the rules requiring the following from each player:

a) the operation of said random number devices to display discrete numbers simultaneously;

b) the application of one or more similar or different arithmetic operations to create from the discrete numbers a selected number;

c) the selection of a zone or playing piece with the selected number;

d) the positioning of a playing piece on the zone with the selected number or the positioning of the playing piece with the selected number on a zone;

e) operating a reward scheme for each piece positioned in a zone; and f) terminating the game when a player reaches or exceeds a predetermined target reward in said scheme.

6. A game according to claim 5, wherein the zones are arranged in different designated groups with the zones of each group bearing the same designation and wherein the rules specify a different reward for placing pieces in differently designated zones.

7. A game according to claim 5, wherein the zones bearing prime numbers in each group carry a different designation and wherein the rules specify the awarding of predetermined higher reward in said scheme when a playing piece is placed on a zone bearing a prime said number.

8. A numeric game comprising:

a board;

means defining a plurality of separate zones on the board, wherein the zones are hexagons arranged in an interlocking array, and wherein the plurality of zones are one hundred and are numbered from one to a hundred;

a plurality of random number devices capable of displaying a corresponding plurality of random numbers simultaneously;

a plurality of playing pieces, wherein each playing piece comprises a counter carrying a different one of said plurality of numbers;

a pack of cards, each card of said pack carrying one of a plurality of different scoring instructions; and a set of rules, the rules requiring the following from each player:

a) the operation of said random number devices to display discrete said numbers simultaneously;

b) the application of one or more similar or different arithmetic operations to create from the discrete numbers a selected number;

c) the selection of a zone or playing piece with the selected number;

d) the positioning of a playing piece on the zone with the selected number or the positioning of the playing piece with the selected number on a zone;

e) operating a reward scheme for each piece positioned in a zone;

f) terminating the game when a player reaches or exceeds a predetermined target reward in said scheme;

g) after a first counter has been placed on the board, successive said counters must be placed in contiguous relationship with another said counter on the board; and h) when a said counter is placed on the board to create two intersecting chains of continuous zones in which the numbers in each of said chains are mathematically interrelated, a said card be selected from the pack and acted on.

9. A game according to claim 8, wherein selected zones are marked with a bonus scoring instruction.

* * * * *